United States Patent [19]

Haenni et al.

[11] Patent Number: 5,024,349

[45] Date of Patent: Jun. 18, 1991

[54] TUBE DISPENSER FOR FLEXIBLE SHEET MATERIAL

[75] Inventors: Edwin W. Haenni, Hartsville; Hans-Peter Bolz, Greenville, both of S.C.

[73] Assignee: Sonoco Products Company, Hartsville, S.C.

[21] Appl. No.: 349,289

[22] Filed: May 9, 1989

[51] Int. Cl.[5] ..... B65H 1/00

[52] U.S. Cl. ..... 221/46; 221/61; 221/63; 221/197; 221/281; 221/312 C; 225/14; 225/15

[58] Field of Search ..... 221/33, 44, 46, 45, 221/47, 55, 61, 63, 26, 197, 281, 303, 312 R, 312 C; 206/409, 233, 229, 225; 225/14, 15, 53, 106; 242/55.2, 55.53

[56] References Cited

U.S. PATENT DOCUMENTS

| | | | |
|---|---|---|---|
| 2,031,033 | 2/1936 | Denebeim | 225/53 X |
| 2,783,878 | 3/1957 | Traver | 225/53 X |
| 3,098,594 | 7/1963 | Williamson | 225/106 X |
| 3,291,299 | 12/1966 | Minnotte, Jr. . | |
| 3,868,052 | 2/1975 | Rockefeller | 225/106 |
| 4,274,573 | 6/1981 | Finkelstein | 206/409 X |
| 4,289,262 | 9/1981 | Finkelstein | 225/106 |
| 4,549,689 | 10/1985 | Bailey | 225/49 X |
| 4,583,642 | 4/1986 | Blythe et al. | 221/303 |
| 4,648,530 | 3/1987 | Granger | 221/34 |
| 4,793,539 | 12/1988 | Haenni et al. | 225/106 |

FOREIGN PATENT DOCUMENTS

| | | | |
|---|---|---|---|
| 611187 | 12/1960 | Canada | 206/409 |
| 85861 | 9/1965 | France | 221/47 |

*Primary Examiner*—David H. Bollinger

*Attorney, Agent, or Firm*—Dennison, Meserole, Pollack & Scheiner

[57] ABSTRACT

A dispenser comprising an elongate rigid hollow cylindrical tube including opposed ends and a transverse elongate dispensing slot laterally therethrough at a midpoint along the length thereof. The dispensing slot includes opposed serrated edges with the teeth of each edge overlapping the teeth of the other edge to provide for restricted passage of film bags pulled outwardly through the dispensing slot from the interior of the tube. The opposed ends of the dispensing slot are enlarged and smooth-edged for access to interior bags and cooperation with the serrated edges in providing for projecting leading bag corners.

10 Claims, 2 Drawing Sheets

TUBE DISPENSER FOR FLEXIBLE SHEET MATERIAL

BACKGROUND OF THE INVENTION

Plastic bags, that is bags of thin flexible plastic film material, have become increasingly popular and, in various forms, are used for an ever-increasing variety of purposes, including grocery bags, garbage bags, lawn or yard care bags, product packaging bags, and the like.

The bags, because of the thin film-like nature thereof, are, notwithstanding their adaptability to many tasks, frequently difficult to handle, that is store, individually dispense and open for use. As a matter of manufacturing expedience and handling convenience, the plastic bags are frequently provided in a roll of a continuous strip of bags formed from an endless tube of plastic film transversely bonded or seamed with adjacent parallel severance lines, normally lines of minute perforations, to allow for a severance of the individual bags from the roll. Rolls of grocery bags formed in this manner will be noted in U.S. Pat. No. 4,793,539, issued Dec. 27, 1988, to Haenni et al.

The Haenni et al patent also illustrates a manner of positioning the roll and dispensing the bags therefrom wherein the roll is mounted within the base of a check-out counter and the bags individually dispensed through a bag severing and dispensing nozzle mounted within the countertop remote from the roll.

While bag storage and dispensing in this manner is quite acceptable for use in a grocery store environment, such an arrangement would not be feasible in providing for bag access under many other conditions, for example in the yard for lawn clippings and debris, in an industrial environment for either product packaging or waste materials collection, or even in a home kitchen for garbage bag storage and dispensing.

While various forms of dispensers for sheet material, including wrapping paper, paper toweling, and the like, are known, including elongate containers of both circular and rectangular cross section, such containers are often rather elaborately constructed units adapted for particular products having little relationship to plastic film bags and the problems attendant to dispensing and use thereof.

SUMMARY OF THE INVENTION

The present invention provides a combination device for both storing a roll of separably joined plastic bags and the like, and dispensing individual bags automatically severed from the roll in conjunction with the manual pulling of the leading bag on the roll from the device.

The dispenser is particularly adapted for use in any environment wherein the bags might be desired, with the orientation of the dispenser, through appropriate mounting brackets, or the like, being readily accommodated to the point-of-use requirements, and not dictated by the construction of the dispenser itself which is substantially universally adaptable. Contemplated uses of the dispenser include a direct mounting thereof on lawn mowers, farm tractors, or the like; grocery store check-out counters and produce areas; manufacturing facilities for product packaging; and a wide variety of other areas wherein the use of readily available plastic bags is desired.

The dispenser comprises a rigid cylindrical tube, preferably of plastic such as polystyrene or a similar appropriate material. The dispenser, when formed of plastic, is particularly adapted to be formed economically from a continuous extruded length of tubing from which sections are severed in accord with the length of dispenser desired. Each severed section includes an elongate dispensing slot along a minor portion of the length of the section-forming dispenser which may be formed, by die cutting or the like, either prior or subsequent to severance of the section from the extruded length. The dispenser thus formed includes open ends and a constant circular cross section throughout the length thereof for unencumbered loading of a roll of bags or the like therein from either end.

The centrally located elongate dispensing slot includes, for a major portion of the length thereof, opposed parallel slot edges preferably of a zig-zag or saw-tooth configuration defining a series of integral teeth, each series of which passes beyond the longitudinal central line of the slot into spaced generally internesting relation to the teeth of the other edge to restrict movement of the bags through the slot. The opposed ends of the slot are provided with smooth edged extensions, preferably in the nature of manual access openings allowing for a physical grasping of the leading bag of the roll toward the opposed corners thereof. The actual size of the tube dispenser will be determined by the size of the bags to be dispensed. In each case, the dispenser will be an economically feasible self-contained one-piece device with an integral dispensing and severing slot and with or without additional components, such as end caps.

Further features and advantages of the invention will become apparent from the more detailed description of the invention following hereinafter.

DESCRIPTION OF PREFERRED EMBODIMENTS

Figure 1:
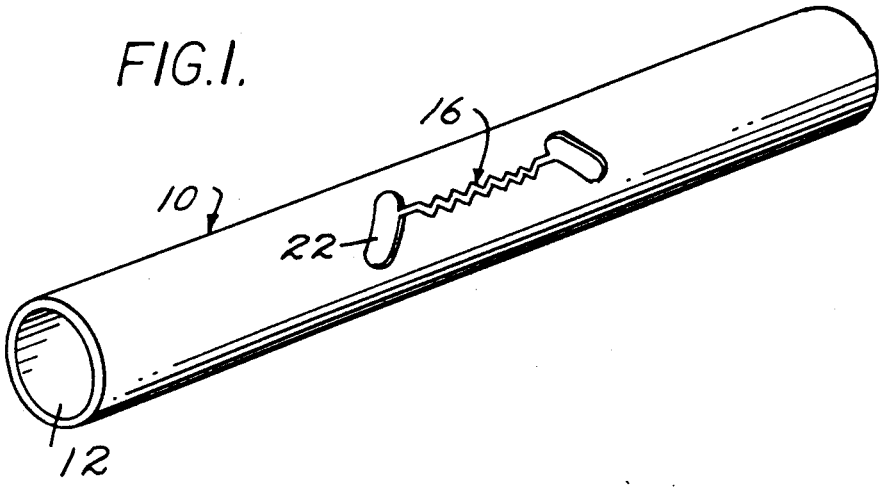
FIG. 1 is a perspective view of the dispenser of the invention.
Figure 2:
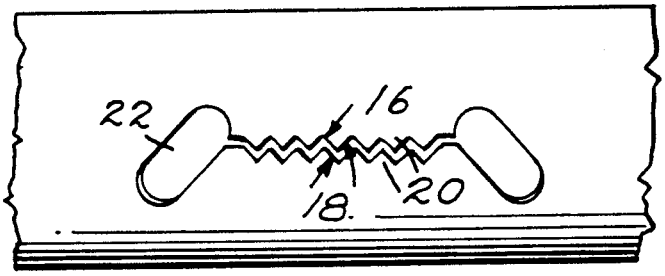
FIG. 2 is a plan view of the dispensing slot.

Referring now more specifically to the drawings, the one-piece tube or tubular dispenser of the invention is designated by reference numeral 10. The dispenser 10 is preferably formed of a rigid shape-sustaining plastic, such as polystyrene, and is of a cylindrical configuration with a constant circular cross section and a constant diameter hollow interior throughout the length thereof between opposed open ends 12.

As will be readily appreciated, the roll of plastic film bags or the like 13 is conveniently introduced through either tube end 12.

Figure 7:
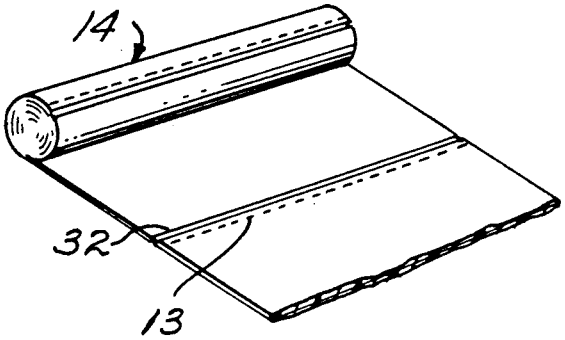
FIG. 7 is a perspective view of a typical roll of bags to be used with the dispenser.
Figure 7:
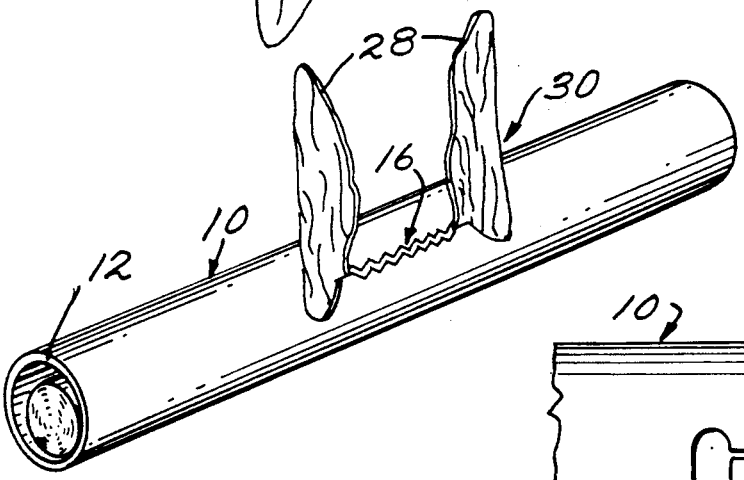

The bag roll 14, noting FIG. 7, will in most instances comprise a continuous series of bags, whether flat-top bags or T-shirt bags, joined along transverse severance lines 13 normally defined by lines of perforations for selective severance of a leading bag 15 from the roll for a sequential dispensing of the bags. While the bag roll is the preferred form of bag package, it is also possible that the individually severable bags can be provided in a fan-folded package of a size receivable within a corresponding dispenser 10.

The actual dispensing of the individual bags is effected through the dispensing slot 16 longitudinally defined centrally through the tube or tubular dispenser 10 for a minor portion of the length of the tube. The dispensing slot 16 includes an elongate central portion defined by parallel opposed longitudinally extending zig-zag or sawtoothed edges 18 forming opposed series of teeth 20 which are longitudinally offset from each other with the teeth of each series projecting laterally beyond a common central plane between the edges and into slightly overlapped position relative to the teeth of the second series of teeth. Formed in this manner, no planar sheet material can be drawn through the slot without engagement with at least one series of teeth.

The opposed ends of the dispensing slot 16, beyond the toothed central portion thereof, are smooth edged and include enlarged access ports 22 which communicate directly with the elongate central portion of the slot and extend laterally at approximately 45° thereto. The access ports are preferably of a size sufficient to allow for easy access to the interior bag roll by, for example, the index finger and thumb of a user's hand for grasping the first bag on a roll 14 to initiate dispensing of the bags from the roll. Alternatively, the access ports can accommodate mechanical grasping means, such as suction cups, for an automated system of bag withdrawal. Once the first bag is introduced into the dispensing slot 16, the following bags will automatically be positioned as will be explained presently. As an example of dimensions, a tube for accommodating standard size $9\frac{1}{2}'' \times 6'' \times 18\frac{1}{2}''$ plastic grocery bags, whether flat-topped bags or T-shirt bags, can have a length of approximately 20" (508 mm.), a diameter of approximately 4" (101.6 mm.), and a dispensing slot of approximately 4" (101.6 mm.) equally spaced from the opposed ends of the tube. The tube dispenser can be of practically any size, limited only by the environment of use, and the size of the bags and bag roll. The access ports 22 of the dispensing slot, in order to accommodate the thumb and index finger, will preferably be about $\frac{7}{8}''$ wide (22.23 mm.) and 2" (50.8 mm.) long.

The enlarged oblong configuration of the access ports 22 is particularly desirable in facilitating access to the leading bag of a newly inserted roll under what might normally be considered adverse conditions, such as while wearing gloves during yard work, or the like.

Figure 3:
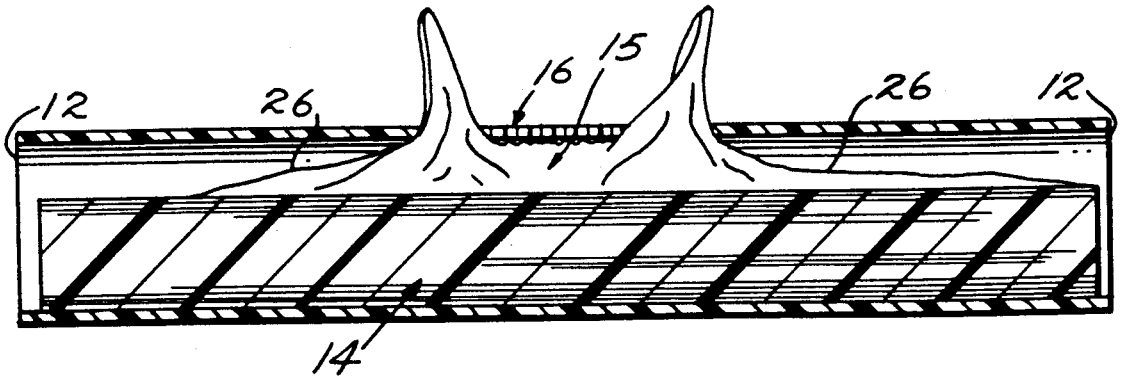
FIG. 3 is an enlarged cross-sectional view through the dispenser illustrating the relationship of the bag roll and leading bag to the dispenser preparatory to dispensing of the leading bag.

In actual use, a package of bags 14 is slid into the tube from either end 12 thereof and a portion of the leading bag 15, preferably the free edge thereof, outwardly drawn through the access ports 22 sufficient to engage the edges of the slot 16 as suggested in FIG. 3. So positioned, the opposed side edges 26 of the leading bag 15 are tensioned to effect an inwardly directed force on the opposed ends of the roll 14, tending to centrally stabilize the roll within the tube 16 and preclude accidental shifting of the roll through the open tube ends 12, without requiring the provision of separate end caps or other retaining means. As suggested in FIG. 3, the bag, while drawn through a centrally located slot for roll stabilization and convenience, is grasped at spaced points along the leading edge portion thereof in light of the elongate nature of the slot and the access ports 22 to the opposed ends thereof. Thus, and as suggested in FIG. 4, the opposed corners 28 of the bag are readily accessible even when utilizing a single hand to withdraw the bag, as would in most cases be done. This ready accessibility to the corners of the bag is significant in facilitating a holding, spreading and opening of the bag for use, particularly in view of the extremely thin nature of the film material and the attendant problems of static cling and the like associated therewith. Were the bag drawn through the dispensing slot 16 by merely grasping a central point along the leading edge or an intermediate portion thereof, the opposed corners would inwardly fold into the bag structure so as to require substantial bag manipulation for access thereto. Under most circumstances, such as in high speed grocery store operations or when wearing gloves as in a lawn care environment, this would not be very practical or desirable.

Figure 4:
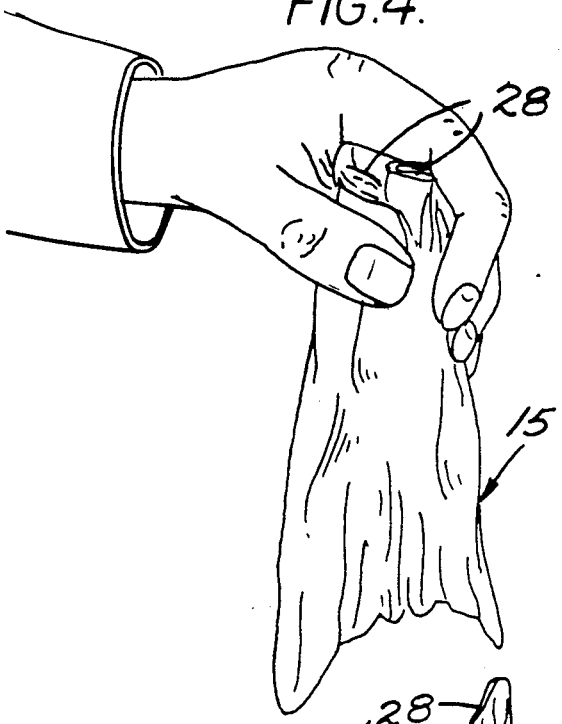
FIG. 4 is a view illustrating severance of the leading bag and orientation of the subsequent bag.

With reference to FIG. 4, as the leading bag 15 is drawn through the dispensing slot 16, the tensioned longitudinal edges of the bag preclude a longitudinal shifting of the roll. Upon the severance line or perforated line 13 between the leading bag 15 and the bag 30 following immediately therebehind reaching the dispensing slot 16, the opposed series of teeth 20 engage the severance line or perforations and provide an increased resistance to withdrawal of the leading bag 15 sufficient to cause a severance of the leading bag 15 from the following bag 30. The actual severance may be facilitated by a rather sharp pull on the leading bag as the teeth engage the perforations, although the simple action of a continuous pull on the leading bag should be sufficient to effect the severance. The overlapped nature of the opposed series of teeth 20 ensure proper engagement with the perforations and prevent passage of the following bag 30 regardless of the direction of pull on the leading bag.

With continued reference to FIG. 4, it will be noted that the smooth-edqed end portions of the slot 16, principally the access ports 22, allow for passage of the opposed corners 28 of the following bag 30 through the slot 16 prior to severance, which will occur as increased tension is developed between the teeth-retained central portion of the following bag and the corners 28 drawn through the end portions of the dispensing slot 16.

The projecting corners 28, as illustrated in FIG. 4, are retained by the dispensing slot 16 and in turn both retain the roll 14 within the tubular dispenser 10 and provide for ready access to the leading corners of the "new" leading bag. Each subsequently presented bag will similarly be accessible for a grasping of the opposed leading corners in one or two hands. In every case, the opposed corners are readily available for convenient use of the bag once removed from the dispenser.

Figure 5:
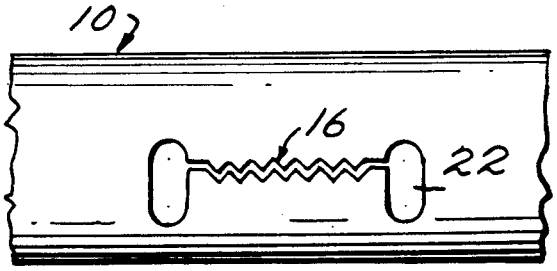
FIG. 5 is a plan view of an embodiment of the dispensing slot.

FIG. 5 illustrates the dispensing slot 16 with the opposed access ports 22 oriented at right angles to the toothed central portion of the slot 16.

Figure 6:
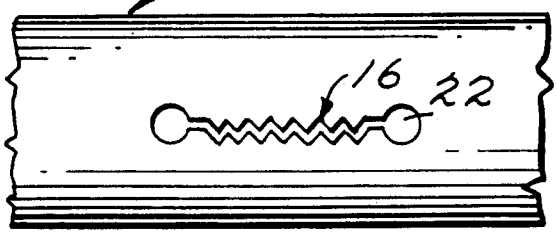
FIG. 6 is a further embodiment of the dispensing slot.

In FIG. 6, the access ports 22, also to the opposed ends of the central toothed portion of the slot 16, are circular. While not illustrated, it is conceivable that a single access port at only one end of the dispensing slot can be provided. However, for the reasons noted above, it is clearly preferred that two such ports be utilized.

FIG. 7 illustrates a typical roll of plastic bags wherein the individual bags are defined by transverse seams 32 with adjacent lines of perforations or severance lines 13 as referred to above.

The dispenser, as described, can be used as a hand-held unit, that is held in one hand while the bags are dispensed by the other hand. Alternatively, the dispenser, comprising a cylindrical tube with opposed open ends and a lateral dispensing slot, is uniquely adapted for use in substantially any environment utilizing any appropriate mounting means, for example encircling straps or bands for securement to the handle of a lawn mower, screws for direct securement beneath a kitchen cabinet, fixed brackets at a grocery store check-out counter, and the like.

The foregoing is illustrative of the principles of the invention and the substantial scope of the areas of use resulting from the uniqueness and universality of the dispenser.

We claim:

1. A storage and dispensing tube for receiving a package of flexible bags joined in a continuous strip with transverse severance lines between adjacent bags, and for allowing the severance and dispensing of individual bags from the package; said tube being elongate with a hollow interior and opposed ends, a dispensing slot defined in said tube centrally along the length thereof for the dispensing of bags therethrough from the tube interior, said slot being elongate, inwardly spaced from the opposed ends of the tube and of a length comprising a minor portion of the length of the tube, said slot including an elongate central portion with means for engaging the severance line between a leading bag and a following adjacent bag for resisting free movement of the following bag therethrough upon a manual outward pulling of the leading bag through said slot with sufficient resistance to effect severance of the leading bag from the following bag and the strip of bags, said slot including means for positioning the following bag and tensioning opposed side edges of the bag with a portion of the following bag retained by and outwardly projecting from said slot, said means for positioning and tensioning the following bag comprising spaced end portions of the slot to the opposed ends of the elongate central portion, said end portions, along the length of the slot, being of a length substantially less than the length of the central portion, said end portions being transversely enlarged relative to said central portion and including peripheral edge allowing passage of leading portions of the following bag, adjacent opposed corners thereof, through the end portions of the slot with reduced resistance relative to the central portion and prior to severance of the leading bag from the following bag, whereby opposed corners of the following bag outwardly project through the end portions of the slot in longitudinally spaced relation to each other to allow for a manual grasping of the opposed projecting corners for withdrawal of the following bag with the corners manually retained for manipulation of the withdrawn bag and such that the opposed side edges of the bag are tensioned to effect an inwardly directed force on opposed ends of the package thereby tending to centrally stabilize the package within the tube.

2. The storage and dispensing tube of claim 1 wherein said means for engaging said severance line comprises opposed substantially parallel edges, each with projecting teeth extending beyond a common plane parallel to and centrally between these edges for engagement with the severance line regardless of the direction of pull on the leading bag.

3. The storage and dispensing tube of claim 2 wherein said end portions of said slot are each of an oblong configuration with a major portion of the length thereof extending laterally to one side of the central portion of the slot for simultaneous engagement of grasping means inwardly therethrough into the interior of the tube for grasping the first leading bag of a package of bags introduced into the dispensing tube.

4. The storage and dispensing tube of claim 3 wherein said oblong end portions are at an approximately angel of 45° to said central portion.

5. The storage and dispensing tube of claim 1 wherein said tube is of a length to accommodate packages of bags of a width substantially greater than the length of said slot.

6. The storage and dispensing tube of claim 1 wherein said end portions of said slot define access means through said tube and into the interior thereof for enabling the introduction of grasping means inwardly therethrough into the interior of the tube for grasping the first leading bag of a package of bags in the dispensing tube.

7. The storage and dispensing tube of claim 6 wherein the defined access means is of a size to accommodate two fingers of a user of the tube, said fingers comprising said grasping means.

8. The storage and dispensing tube of claim 7 wherein said means for engaging said severance line comprises opposed substantially parallel edges, each with projecting teeth extending beyond a common plane parallel to and centrally between the edges for engagement with the severance line regardless of the direction of pull on the leading bag.

9. A storage and dispensing tube for receiving a package of flexible bags joined in a continuous strip with transverse severance lines between adjacent bags, and for allowing the severance and dispensing of individual bags from the package in response to a continuous pull on said bags; said tube being elongate with a hollow interior and opposed ends, a dispensing slot defined in said tube centrally along the length thereof for the dispensing of bags therethrough from the tube interior, said slot being elongate, inwardly spaced from the opposed ends of the tube and of a length comprising a minor portion of the length of the tube, said slot to receive and dispense said bags along the full length of the slot, said slot including an elongate central portion with means for engaging the severance line between a leading bag and a following adjacent bag for resisting free movement of the following bag therethrough while allowing for a manual outward pulling of the leading bag through said full length of said slot with sufficient resistance to effect severance of the leading bag from the following bag and the strip of bags as the corresponding severance line engages said elongate central portion during a continuous pull on the leading bag, said slot including means for positioning the following bag and holding a side edge of the bag with a portion of the following bag retained by and outwardly projecting and holding from said slot, said means for positioning the following bag comprising an end portion of the slot to one end of the elongate central portion, said end portion, along the length of the slot, being of a length substantially less than the length of the central portion, said end portion being transversely enlarged relative to said central portion and including peripheral edges allowing passage of a leading portion of the following bag, adjacent a corner thereof, through the end portion of the slot with reduced resistance relative to the central portion and prior to severance of the leading bag from the following bag, whereby a corner of the following bag outwardly projects through the end portion of the slot to allow for a manual grasping of the projecting corner for withdrawal of the following bag through the slot with the corner manually retained for manipulation of the withdrawn bag and such that the side edge of the bag is held to effect a force on the package thereby tending to stabilize the package with the tube.

10. The storage and dispensing tube of claim 9 wherein said means for engaging said severance line comprises opposed substantially parallel edges, each with projecting teeth extending beyond a common plane parallel to and centrally between the edges for engagement with the severance line regardless of the direction of pull on the leading bag.

* * * * *

UNITED STATES PATENT AND TRADEMARK OFFICE

CERTIFICATE OF CORRECTION

PATENT NO. : 5,024,349

DATED : June 18, 1991

INVENTOR(S) : Edwin W. Haenni et al

It is certified that error appears in the above-identified patent and that said Letters Patent is hereby corrected as shown below:

Column 4, line 40, "smooth-edqed" should be --smooth-edged--.

Column 5, line 45, "edge" should be --edges--.

Column 6, lines 57-58, delete "and holding";
line 58, after "positioning" insert --and holding--.

Signed and Sealed this

Twenty-seventh Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,024,349

DATED : June 18, 1991

INVENTOR(S) : Edwin W. Haenni et al

It is certified that error appears in the above-identified patent and that said Letters Patent is hereby corrected as shown below:

Column 6, line 8, "angel" should be --angle--.

Signed and Sealed this

Twenty-fourth Day of August, 1993

Bruce Lehman

*Attest:*

BRUCE LEHMAN

*Attesting Officer*

*Commissioner of Patents and Trademarks*